US006842937B2

(12) United States Patent
Li

(10) Patent No.: US 6,842,937 B2
(45) Date of Patent: Jan. 18, 2005

(54) RAIN-GUTTER CLEANING TOOL SET

(75) Inventor: Mingqi Li, 23035 NE. 13th St., Sammamish, WA (US) 98074

(73) Assignee: Mingqi Li, Sammamish, WA (US)

( * ) Notice: Subject to any disclaimer, the term of this patent is extended or adjusted under 35 U.S.C. 154(b) by 0 days.

(21) Appl. No.: 10/180,180

(22) Filed: Jun. 27, 2002

(65) Prior Publication Data

US 2004/0000020 A1 Jan. 1, 2004

(51) Int. Cl.[7] ..... E04D 13/076
(52) U.S. Cl. ..... 15/236.04; 294/19.1
(58) Field of Search ..... 15/236.01, 236.04; 294/19.1

(56) References Cited

U.S. PATENT DOCUMENTS 5,033,156 A * 7/1991 Stewart
6,139,077 A * 10/2000 Molzan, II
6,526,619 B1 * 3/2003 Cassels, Jr.
2001/0025393 A1 * 10/2001 Nicolette

* cited by examiner

*Primary Examiner*—Randall Chin

(57) ABSTRACT

A gutter-cleaning tool set consists of a lightweight, adjustable or fixed length pole, a gutter-shaped blade, a gutter-shaped brush, a metal pin to lock the blade or brush on the end of the pole and a nylon string to secure the pin to the holding pole, the tool set is designed to collect deposits such as fallen leaves and roof debris in the gutters and to brush the rain gutter for thorough cleaning.

2 Claims, 6 Drawing Sheets

RAIN-GUTTER CLEANING TOOL SET

BACKGROUND OF THE INVENTION

The present invention relates to a rain-gutter cleaning tool. The tool is used for cleaning building rain-gutters and serves the following two purposes:

Making the gutter-cleaning job easier and faster;

Making the gutter-cleaning job easier for gutter sections that are difficult for a ladder to reach because of obstacles such as trees near the building.

SUMMARY OF THE INVENTION

The present invention of a rain-gutter cleaning tool set uses a gutter-shaped blade and brush to allow an operator to clean rain-gutters more efficiently and quickly. The profile of the blade matches the shape of the gutter so that the blade only needs to pass along the gutter section once to collect all leaves and debris inside the gutter section. With the help of a long, lightweight pole, a user can clean a gutter section of about 6 yards from a single ladder position and does not need to move the ladder as often. A user can also clean the gutter sections that cannot be reached easily because of obstacles such as trees near the building. The gutter-shaped brush can also brush the gutter, so it is not necessary to wash the gutter with water.

The present rain-gutter cleaning tool set has several advantages:

1. Simplicity: It only consists of 5 parts: a holding pole, a gutter-shaped blade, a gutter-shaped brush, a metal pin and a nylon string. The assembly takes only a matter of several seconds even for first time users.
2. Efficiency: The gutter-shaped blade and brush fit the profile of the gutter very well so an operator can efficiently and quickly clean the rain-gutter. It can clean a gutter section of about 6 yards from a single ladder position. To clean the gutter on one side of a normal residential house, the user may only have to move the latter once or twice. The user saves time going up and down the ladder and from not having to move the ladder so often.
3. Versatility: With the help of a long, lightweight pole, the user can easily clean the gutter sections that are difficult to reach.
4. Lightness: The entire tool set only weights about 10 ounces.
5. Cost efficiency: The tool set costs only a few dollars.

DETAILED DESCRIPTION OF THE INVENTION

Figure 1:
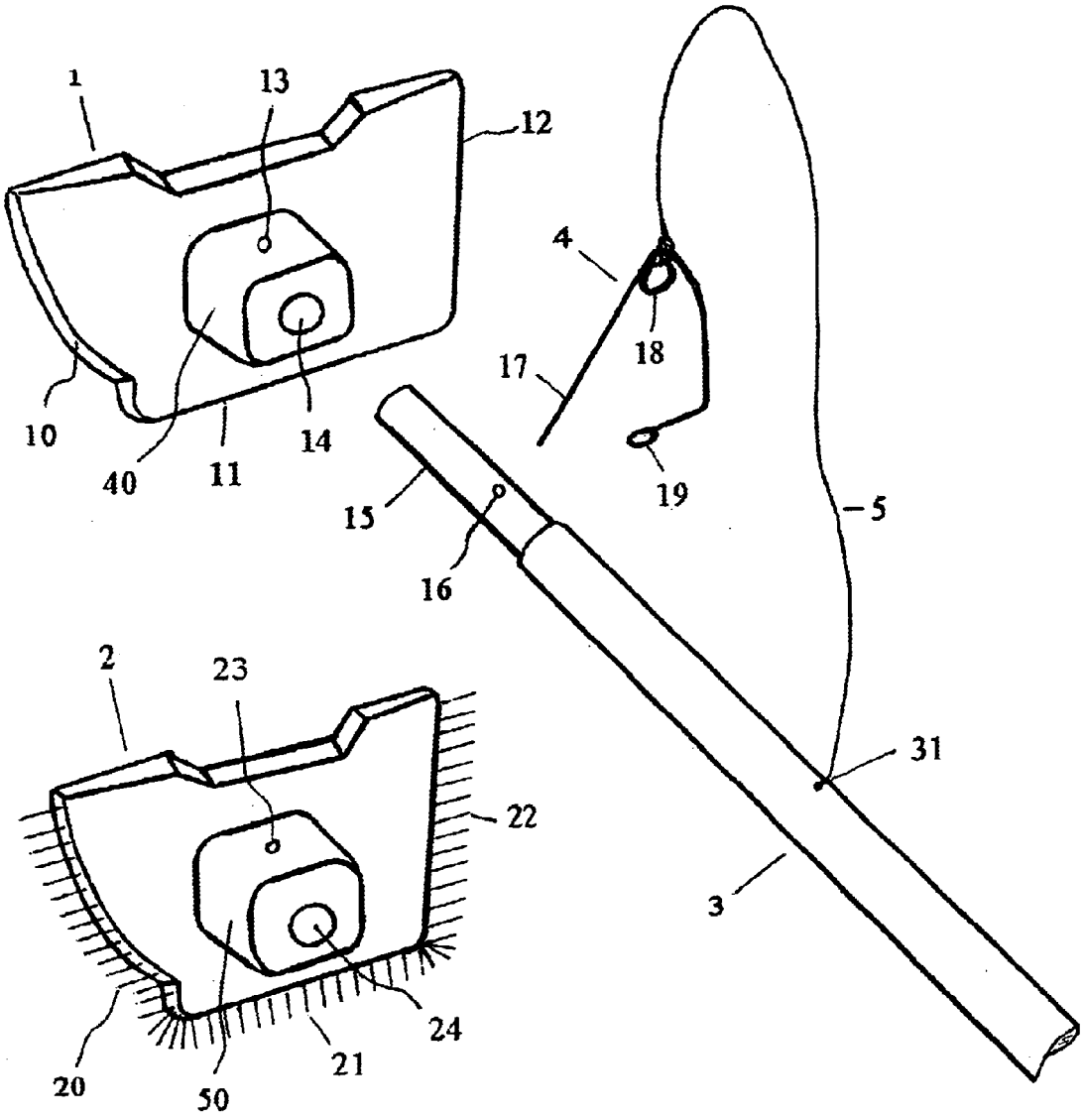
FIG. 1 is a diagram showing all parts of the tool set
Figure 2:
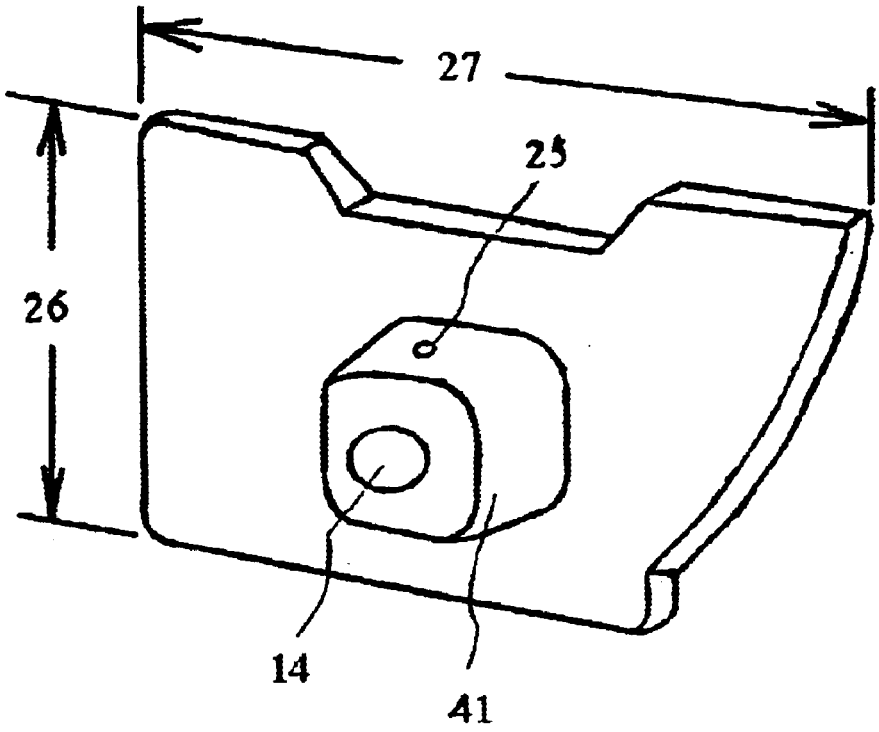
FIG. 2 is a rear view of gutter-shaped blade 1 showing the width 27, height 26 and a second small hole 25
Figure 3:
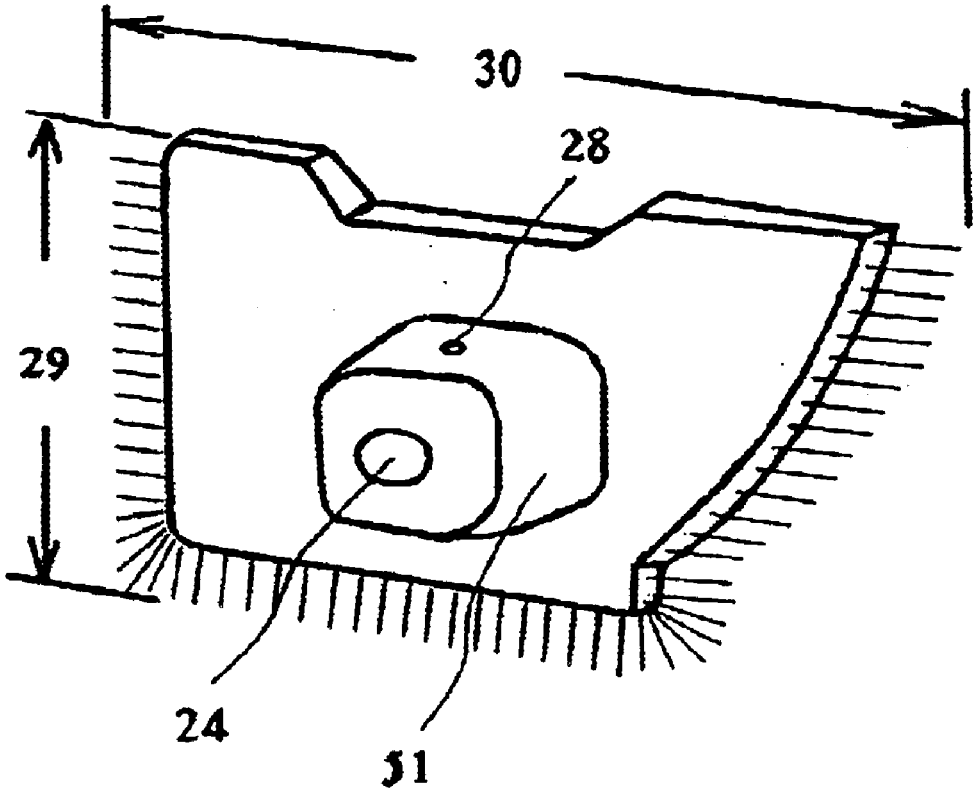
FIG. 3 is a rear view of gutter-shaped brush 2 showing the width 30, height 29 and a second small hole 28

This rain-gutter cleaning tool set has the following 5 parts

A gutter-shaped blade 1

A gutter-shaped brush 2

A holding pole 3

A metal pin 4

A nylon string 5

A gutter-shaped blade 1 is made of plastic or other lightweight material. The blade profile is the same shape as the cross-section of the rain-gutter 6 such that blade edges 10, 11 and 12 follows the contour of the inside of the gutter. The width 27 of blade 1 is marginally smaller than the width of the cross-section of the gutter 6. So there is some clearance space between the rain-gutter 6 and the blade 1 to allow the blade 1 to move smoothly inside the gutter 6 while the gutter is being cleaned. The height 26 of blade 1 is low enough to allow blade 1 to pass smoothly inside the gutter.

The purpose of having the profile of the blade match the shape of the gutter is to make the clearance between the blade and the gutter so small that the blade only needs to pass along the gutter section once to collect all leaves and debris inside the gutter section.

The shapes and sizes of the blades are different from different rain-gutter types and sizes. Appropriately shaped and sized blades are used for different gutter types on different buildings.

The gutter-shaped blade 1 has a larger hole 14 that goes completely through it. The shape of the large hole 14 on the blade 1 and the shape of section 15 of the pole 3 should be same. The size of the large hole 14 on the blade 1 is marginally larger than the size of section 15 of the holding pole 3 so that section 15 of the pole 3 can be easily inserted into this large hole 14 on the blade 1.

The gutter-shaped blade 1 has two small holes 13 and 25. The purpose of the two small holes in the blade is to lock the blade on the holding pole 3. This is done by inserting section 17 of the metal pin 4 into hole 13 to clean the gutter section on the user's left side, or by inserting section 17 of the metal pin 4 into the other hole 25 to clean the gutter section on the user's right side.

The gutter-shaped blade 1 includes blocks 40 and 41 on each side of the blade 1. Block 40 includes hole 14 and block 41 includes hole 25.

The size and shape of the gutter-shaped brush 2 is exactly the same as the size and shape of blade 1 for a given size of rain-gutter. In the same way as for the gutter-shaped blade 1, the gutter-shaped brush 2 has a large hole 24 that goes completely through it. Holding pole 3 is inserted into hole 24. The shape and size of the large hole 24 on the gutter-shaped brush 2 is the same as the shape and size of the large hole 14 on the gutter-shaped blade 1. In the same way as for gutter-shaped blade 1, the gutter shaped brush 2 also has two small holes 23 and 28. The diameters of these two small holes on the brush are the same as the diameters of the small holes on a blade 1. The only difference between blade 1 and brush 2 is that there are bristles on edges 20, 21 and 22 of brush 2. Brush 2 works in the same way as blade 1: pole 3 is inserted into the hole 24 of brush 2 and held in place by inserting section 17 of pin 4 into hole 23. This is the assembly arrangement for brushing the gutter on the user's left side Pole 3 is held in place by inserting pin 4 into hole 28 in order to brush the gutter on the user's right side.

The gutter-shaped brush 2 is used to brush the rain-gutter to achieve a finer degree of cleaning.

The holding pole 3 is up to 7 feet or in length. The pole is made of lightweight material. With the help of the long, lightweight pole, the user can clean a gutter section of about 6 yards from each ladder position or clean the gutter sections that are difficult to reach because of obstacles near the buildings.

The size of section 15 of the pole 3 is smaller than the size of the rest of the pole. This prevents the pole 3 from being inserted too far into the blade 1 or brush 2.

Pole 3 has a small hole 16 on section 15. The small hole 16 will align with small holes 13 or 25 on blade 1 or small holes 23 or 28 on brush 2 once section 15 of pole 3 is inserted into blade 1 or brush 2. Section 17 of metal pin 4 can then be inserted through these holes to lock blade 1 or brush 2 on pole 3.

The gutter-shaped brush 2 includes blocks 50 and 51 on each side of the brush 2. Block 50 includes hole 23 and block 51 includes holes 28.

The pole 3 has a second hole 31. One end of nylon string 5 goes through hole 31 to tie the metal pin 4 to the pole 3. This is to avoid losing the metal pin 4 while the user is changing the mounted direction of the blade 1 or brush 2.

Pin 4 is made of metal. Pin 4 is used to lock blade 1 or brush 2 in place on the end of pole 3. There is a small circular loop 18 in the middle of pin 4. The purpose of loop 18 is to provide the elasticity to enable the pin 4 to go back to its non-working position once the user unlocks it. Section 17 of pin 4 is straight so that it can go through the small holes on blade 1 or brush 2 and continues through hole 16 on pole 3. There is a lock 19 on one end of pin 4. The user locks pin 4 in place by putting the end of section 17 into hook 19 of the pin.

The nylon string 5 is just a thin nylon string. String 5 is used to tie pin 4 to holding pole 3 to avoid losing the pin during operation.

The user can assemble a tool to collect leaves and debris in rain-gutters by using a gutter-shaped blade 1, a holding pole 3, a metal pin 4 and a nylon string 5. The user can assemble a tool to brush the rain-gutter by using a gutter-shaped brush 2, a holding pole 3, a metal pin 4 and a nylon string 5.

The steps to assemble the tool set are as follows:

1. Insert section 15 of the holding pole 3 into the larger hole 14 on blade 1 or the large hole 24 on brush 2;
2. Insert metal pin 4 through the small hole on the gutter-shaped blade 1 or brush 2;
3. Lock metal pin 4 with hook 19 on the end of the metal pin, so that blade 1 or brush 2 is locked in position on pole 3.

The mounting direction of the cleaning blade 1 and brush 2 can be easily changed as described in the steps below:

1. Unhook metal pin 4 and pull it out of blade 1 or brush 2;
2. Detach blade 1 or brush 2 from section 15 of holding pole 3;
3. Flip over blade 1 or brush 2 and reinsert section 15 of holding pole 3 into blade 1 or brush 2;
4. Insert pin 4 into the small hole on the blade 1 or brush 2 to secure the pole in position;
5. Lock pin 4 in place using hook 19 on the end of the pin, so that blade 1 or brush 2 is locked on pole 3.

Figure 4:
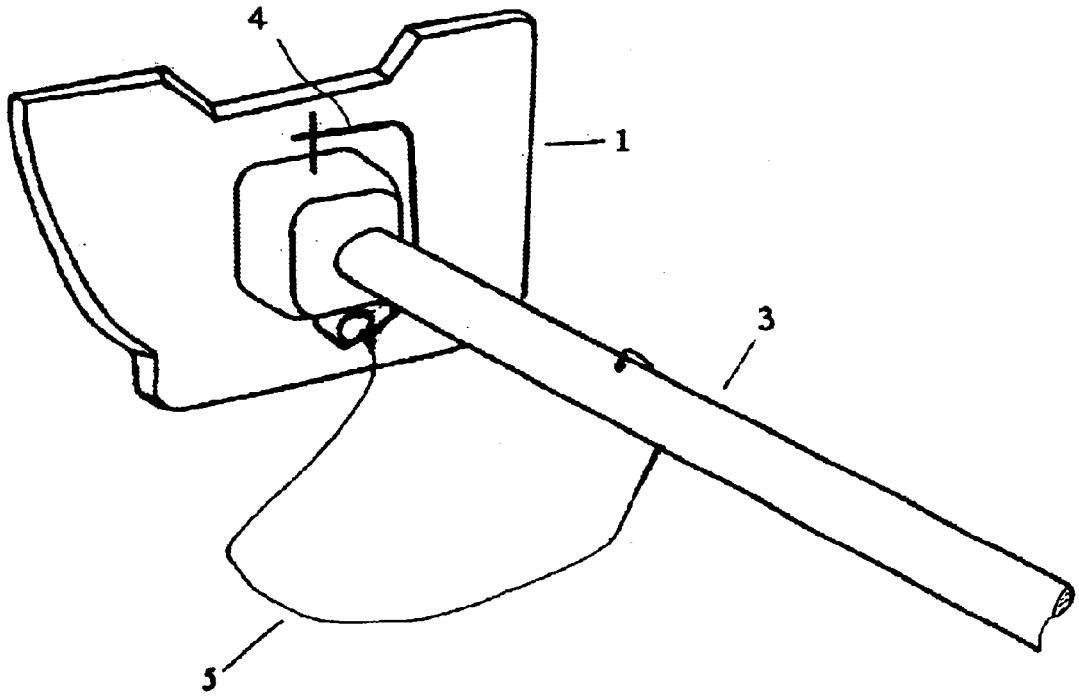
FIG. 4 is a diagram showing the tool assembled with the blade 1 arranged for cleaning the gutter on the left side of the user
Figure 5:
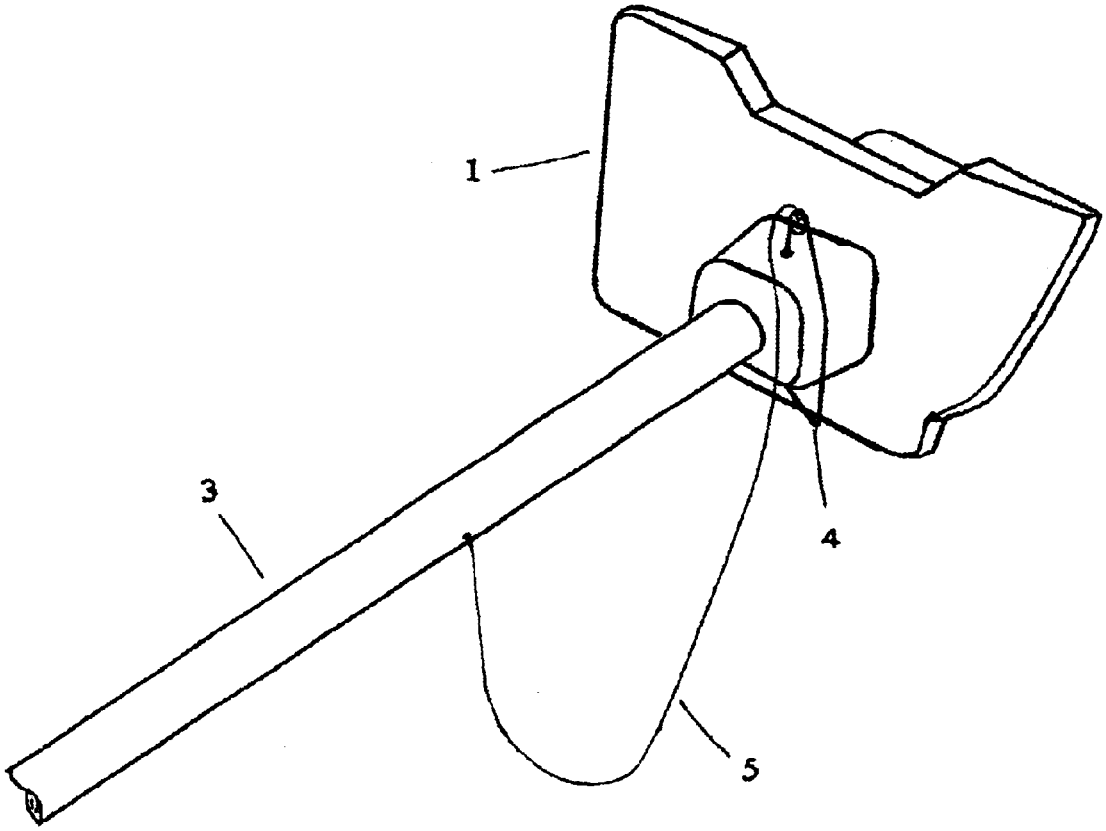
FIG. 5 is a diagram showing the tool assembled with the blade 1 arranged for cleaning the gutter on the right side of the user
Figure 6:
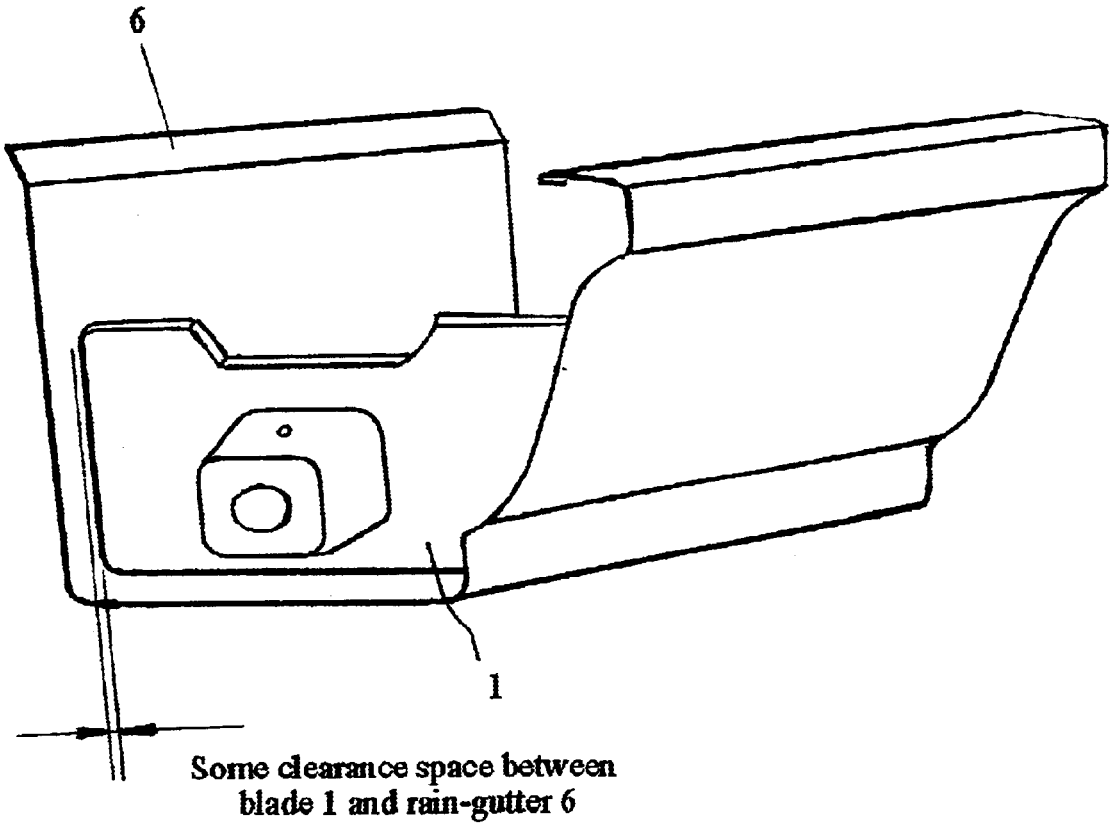
FIG. 6 is a diagram showing the blade 1 inside the rain-gutter 6 with some clearance space between the gutter and blade

The steps below describe how to clean a section of the gutter from a single ladder position:

1. A user locks the gutter-shaped blade 1 on the holding pole 3 as shown in FIG. 4 then uses the tool to pull leaves and debris inside the gutter to the user's left side. The user then removes the leaves and debris from the gutter.
2. The user replaces blade 1 with the gutter-shaped brush 2 and locks it on pole 3. The user then uses the tool to brush the gutter and remove all small particles from the gutter. The brush should be mounted in the same way as blade 1 in the previous step.
3. The user replaces brush 2 with blade 1 again, but this time, the user locks blade 1 on pole 3 as shown in FIG. 5 to collect leaves and debris from the user's right side, and remove them from the gutter.
4. The user replaces blade 1 with brush 2 to brush the gutter on the user's right side and remove all small particles from the gutter. The brush should be mounted in the same way as blade 1 in step 3.

Using a metal pin to lock the gutter-shaped blade or gutter-shaped brush on the end of the holding pole is only of the many possible locking-mechanisms. It will be apparent to those skilled in mechanical design that many changes and modifications may be made without departing from the fundamental principles of the invention in its broader aspects. The appended claims are therefore intended to cover all such changes and modifications that fall within the true spirit and scope of the invention.

I claim:

1. A rain-gutter cleaning tool set comprising a) a holding pole;

b) a gutter-shaped blade with a profile shaped to fit inside a rain-gutter well, the size of the blade is marginally smaller than the size of the rain-gutter, the blade perfectly fits inside the rain-gutter with enough clearance to be smoothly moved back and forth inside the rain-gutter, the height of the blade should be low enough to allow it to pass through spikes that secure the rain-gutter to the building, the blade is appropriately shaped and sized to fit the particular gutter to be cleaned, the blade is locked on the end of said holding pole;

c) a metal pin to lock said blade on said pole; and d) a nylon string to tie said pin to said pole to avoid losing the pin during cleaning and assembly operations.

2. A rain-gutter cleaning tool set comprising a) a holding pole;

b) a gutter-shaped brush with a profile shaped to fit inside a rain-gutter well, the size of the brush is marginally smaller than the size of the rain-gutter, the brush perfectly fits inside the rain-gutter with enough clearance to be smoothly moved back and forth inside the rain-gutter, the height of the brush should be low enough to allow it to pass through spikes that secure the rain-gutter to the building, the brush is appropriately shaped and sized to fit the particular gutter to be cleaned, the brush is locked on the end of said holding pole;

c) a metal pin to lock said brush on said pole; and d) a nylon string to tie said pin to said pole to avoid losing the pin during cleaning and assembly operations.

* * * * *